US009664440B2

(12) United States Patent
Kim

(10) Patent No.: US 9,664,440 B2
(45) Date of Patent: May 30, 2017

(54) REFRIGERATOR WITH A CONFIGURABLE SPACE

(71) Applicant: Dongbu Daewoo Electronics Corporation, Seoul (KR)

(72) Inventor: Jae Sang Kim, Gwangju (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 674 days.

(21) Appl. No.: 14/132,591

(22) Filed: Dec. 18, 2013

(65) Prior Publication Data

US 2015/0135736 A1 May 21, 2015

(30) Foreign Application Priority Data

Nov. 21, 2013 (KR) ..... 10-2013-0142056

(51) Int. Cl.

| | |
|---|---|
| ***F25B 49/00*** | (2006.01) |
| ***F25D 29/00*** | (2006.01) |
| ***F25D 11/00*** | (2006.01) |
| ***F25D 11/02*** | (2006.01) |

(52) U.S. Cl.

CPC ..... *F25D 29/008* (2013.01); *F25D 11/00* (2013.01); *F25D 11/02* (2013.01); *F25D 29/00* (2013.01); *F25D 2400/16* (2013.01); *F25D 2600/06* (2013.01)

(58) Field of Classification Search

CPC ..... F25D 29/008; F25D 11/02; F25D 29/00; F25D 11/00; F25D 2400/16; F25D 2600/06

See application file for complete search history.

(56) References Cited

U.S. PATENT DOCUMENTS

| | | | | |
|---|---|---|---|---|
| 2,957,320 | A * | 10/1960 | Armentrout | F25D 17/062 200/61.62 |
| 6,269,285 | B1 | 7/2001 | Mignault | |
| 2010/0024466 | A1* | 2/2010 | Kwon | F25D 11/02 62/449 |
| 2010/0107677 | A1* | 5/2010 | Bae | F25D 17/065 62/419 |

FOREIGN PATENT DOCUMENTS

| | | | |
|---|---|---|---|
| EP | 1170561 | A1 | 1/2002 |
| EP | 2221562 | A1 | 2/2009 |
| JP | 2006145094 | A | 6/2006 |
| JP | 2008039 | A | 2/2008 |
| JP | 2008170036 | A * | 7/2008 |
| JP | 2010065975 | A * | 3/2010 |
| JP | 2011038677 | A | 2/2011 |
| KR | 1020140072619 | A | 6/2014 |

OTHER PUBLICATIONS

Eijiro, Control Device of Refrigerator, Jul. 24, 2008, JP2008170036A, Whole Document.*

Tomohito, Refrigerator, Mar. 25, 2010, JP2010065975A, Whole Document.*

* cited by examiner

*Primary Examiner* — Larry Furdge

(57) ABSTRACT

A refrigerator including a configurable space having a Hall effect integrated circuit configured to detect a magnetic field and generate an electrical signal; a function control device configured to control an environment of the configurable space according to predetermined or preset information and the electrical signal from the Hall integrated circuit; and a storage bin in the configurable space, having a magnet thereon or therein in a location corresponding to the Hall effect integrated circuit.

9 Claims, 7 Drawing Sheets

(a)

(b)

(a)

(b)

REFRIGERATOR WITH A CONFIGURABLE SPACE

CROSS-REFERENCE TO RELATED APPLICATIONS

This application is based on and claims priority from Korean Patent Application No. 10-2013-0142056, filed on Nov. 21, 2013, the disclosure of which is incorporated herein in its entirety by reference.

TECHNICAL FIELD

The present disclosure relates to a refrigerator with a configurable space.

BACKGROUND

In general, a refrigerator includes a main body, including a freezer and/or a refrigerator chamber, a freezing apparatus in the main body to generate cold air, and a door configured to open and close a front surface of the main body.

A typical freezing apparatus generates cold air by a refrigeration cycle that includes a compressor, an evaporator, a condenser, and the like. The refrigeration cycle includes the compressor for compressing a refrigerant in a gas phase at a high temperature and a high pressure, a condenser for condensing the compressed refrigerant in the gas phase to a liquid state, a capillary tube for changing the liquefied refrigerant to a low temperature and low pressure state, and the evaporator for cooling the surrounding air by absorbing evaporative latent heat in order to gasify the liquefied refrigerant at the low temperature and low pressure by the capillary tube.

The cooling of the refrigerator chamber of the refrigerator is performed by making cold air from the freezer flow into the refrigerator chamber through a duct, so that the temperature of the refrigerator chamber may be generally and uniformly set for example, at approximately 3° C. As described above, an internal side of the refrigerator chamber is cooled within a predetermined temperature range.

In view of the background, it is difficult to store articles that may need to be stored at a different storage temperature, for example, at −1° C. Thus, a function bin (e.g., a compartmentalized space or section of the refrigerator chamber) may have a lower temperature than the temperature of the refrigerator chamber.

As illustrated in FIG. 1, the function bin 3 includes a control panel 5 configured to set a function and a harness 4 (e.g., a temperature detection sensor), that are connected with a printed circuit board (PCB) of the refrigerator.

However, in the function bin 3, the harness is connected to the PCB of the refrigerator, so that it is difficult to attach or detach the function bin.

SUMMARY

The present disclosure has been made in an effort to provide a function (e.g., a configuration) bin or space (e.g., including a food storage bin) in a refrigerating chamber without a connected harness.

Exemplary embodiments of the present disclosure provide a refrigerator including a configurable space including a Hall effect integrated circuit (hereinafter referred to as a Hall IC) configured to detect a magnetic field and convert the detected magnetic field into an electrical signal, and a temperature control device configured to control a temperature with a predetermined range or at a predetermined value according to the electrical signal of the Hall IC; and an accommodation box or storage bin that may be inserted in the configurable space includes a magnet contacting the Hall IC, and that the storage bin having an open surface.

Embodiments of the present disclosure provide a method of configuring a refrigerator that includes detecting, by a Hall IC, a magnetic field of a magnet in or on a storage bin, and generating an electrical signal; receiving the electrical signal in a controller, and reading preset information from a memory; outputting a driving signal configured to drive a load to control a temperature and a humidity according to the preset information; adjusting the amount of cold air inflow with a load driving unit according to the driving signal.

According to various embodiments, it is possible to install the storage bin without the harness, to completely separate the storage bin to provide easy access for removal and cleaning. As a result, it is possible to satisfy user demands, thereby improving the value of the refrigerator.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
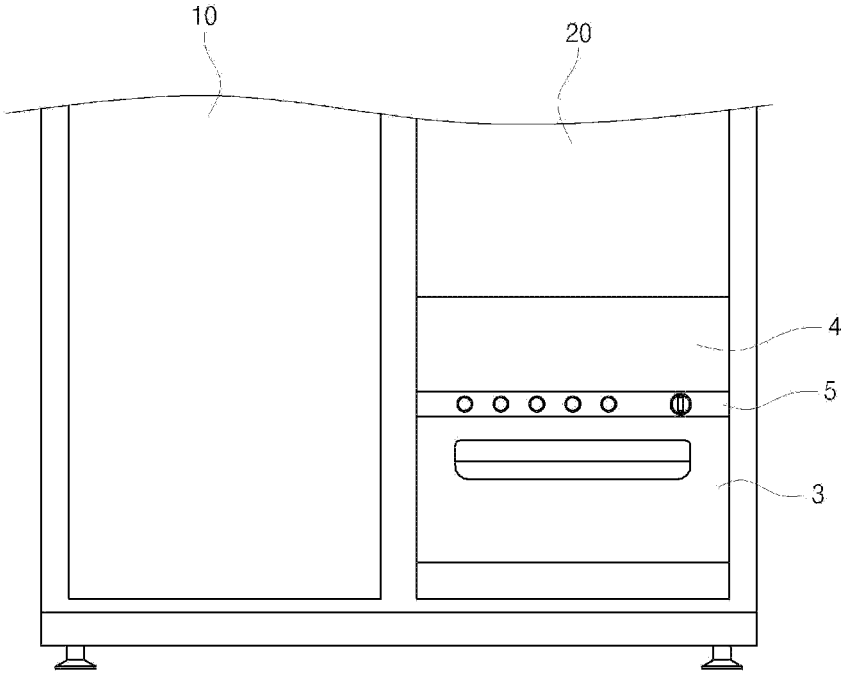
FIG. 1 is a diagram a refrigerator having a function bin in the related art.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described in detail hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to exemplary embodiments described herein. A configuration and an operational effect according to exemplary configurations of the present disclosure will be clearly understood through the detailed description below. Like reference numerals designate like elements throughout the specification and drawings. A detailed explanation of known related functions and constitutions may be omitted when the detailed explanation obscures the subject matter of the present disclosure.

It is noted that the drawings are schematic and are not necessarily dimensionally illustrated. Relative sizes and proportions of parts in the drawings may be exaggerated or reduced in their sizes, and a predetermined size is just exemplary and not limiting.

The exemplary embodiments of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of a form by manufacturing.

Figure 2:
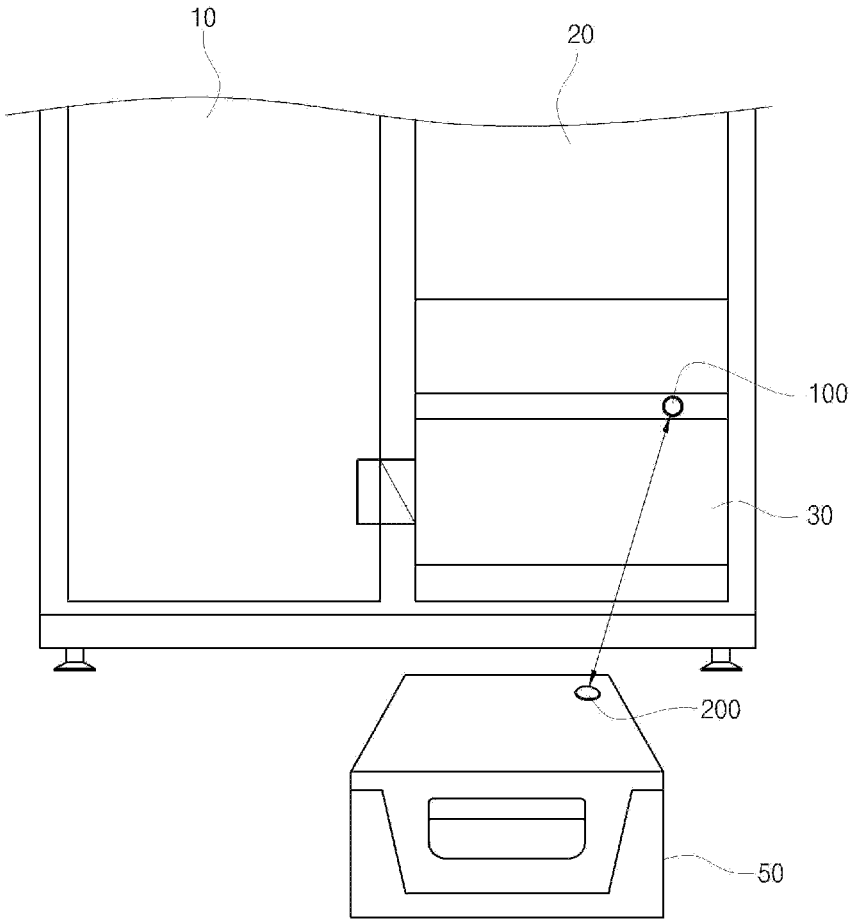
FIG. 2 is a diagram of an exemplary refrigerator with a configurable space according to embodiments of the present disclosure.

FIG. 2 is a diagram of an exemplary refrigerator having a configurable space according to embodiments of the present disclosure.

FIG. 2 illustrates a refrigerator including a freezer 10 and a refrigerator chamber 20 according to embodiments of the present disclosure.

The refrigerator chamber 20 according to embodiments of the present disclosure includes a configurable space 30.

An accommodation box or storage bin 50 configured to store food is in the configurable space 30.

The configurable space 30 includes a Hall effect integrated circuit IC (e.g., a Hall circuit sensor; hereinafter referred to as a Hall IC) 100 configured to detect a magnetic field and convert the detected magnetic field into an electrical signal, and a function control device that includes a printed circuit board (PCB) configured to control a temperature of the configurable space within a predetermined range or at a predetermined value, according to the electrical signal of the Hall IC 100. The function control device will be described below with reference to FIG. 6.

The storage bin 50 includes a magnet 200 on a surface of the box or bin 50 corresponding to and/or in proximity to the Hall IC 100. Alternatively, the magnet 200 may be on top or on the back of the box or bin 50, under a rear wall or top surface of the bin 50, or embedded in the wall or surface of the bin 50.

When the storage bin 50 is in the configurable space 30, the Hall IC 100 detects a magnetic field of the magnet 200 to generate an electrical signal, and the function control device controls an environment in the configurable space 30 (and/or bin 50) according to predetermined or preset information (e.g., conveyed by the electrical signal of the Hall IC 100.

Figure 3:
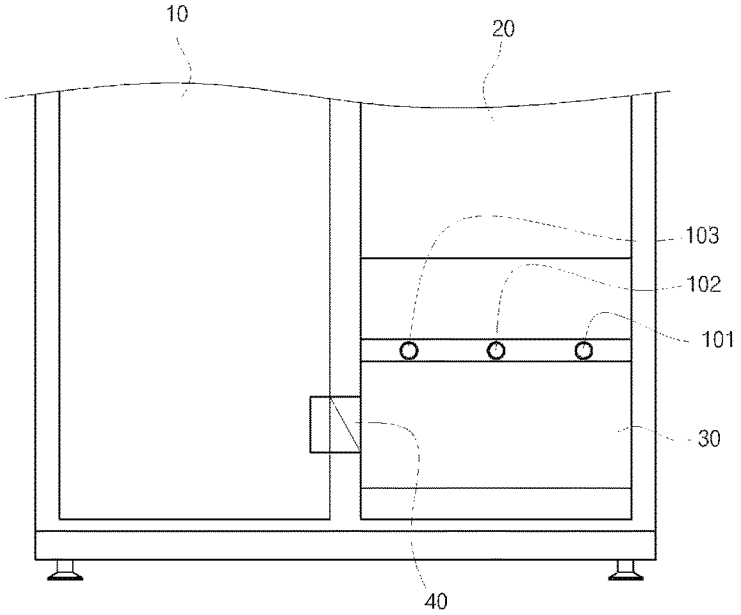
FIG. 3 is a diagram of an exemplary refrigerator with a configurable space according to embodiments of the present disclosure.
Figure 3:
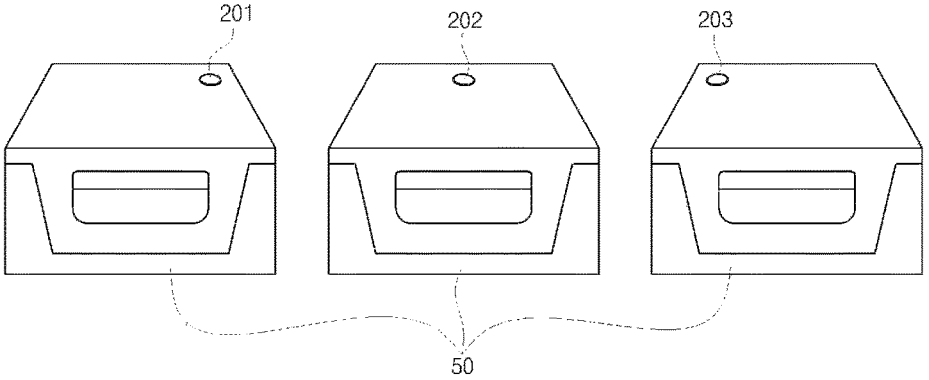
Figure 4:
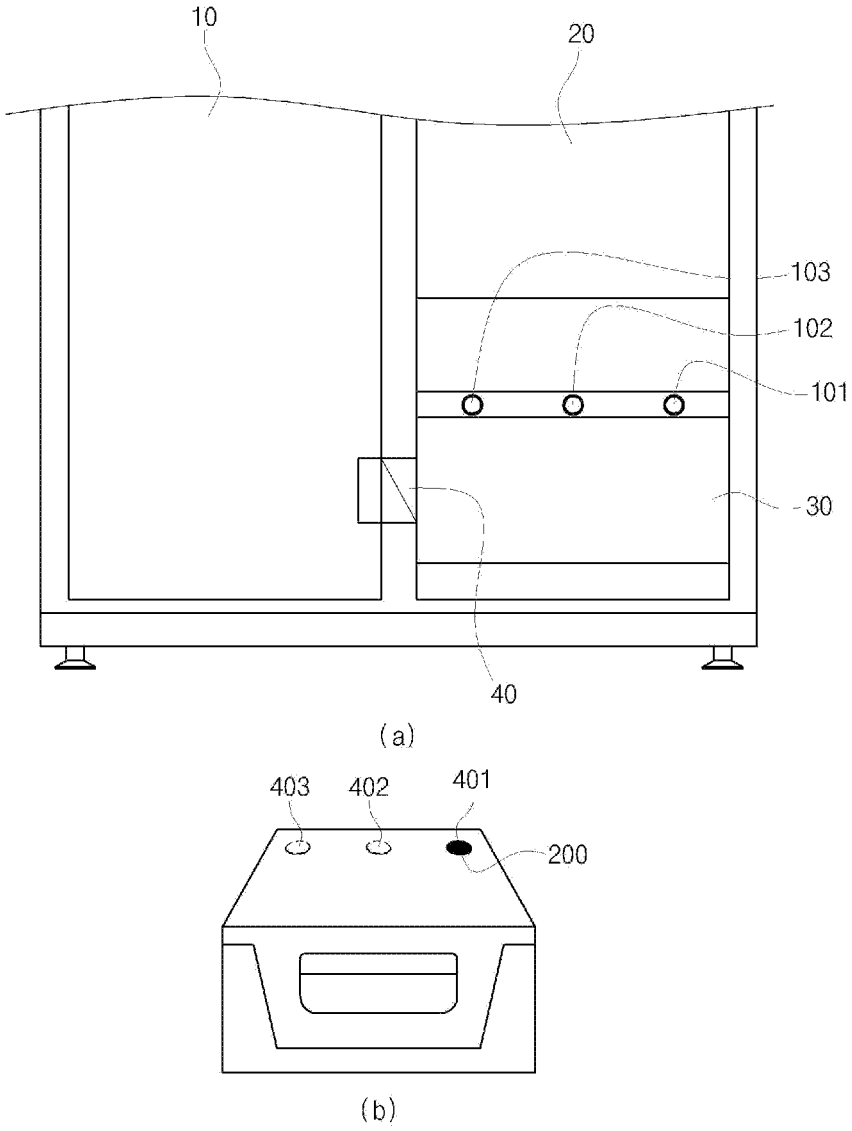
FIGS. 4 and 5 are diagrams of an exemplary refrigerator with a configurable space according to embodiments of the present disclosure.

FIGS. 3 and 4 are diagrams of an exemplary refrigerator with a configurable space in a refrigerator chamber according to further embodiments of the present disclosure.

As illustrated in FIG. 3, a configurable space 30 may include a plurality of Hall ICs 101, 102, and 103.

When the plurality of Hall ICs is included as described above, the respective Hall ICs may correspond to different environments. The environment may include one or more temperature and/or humidity settings, ranges and/or values. The Hall ICs 101, 102, and 103 detect the magnetic field of a magnet 201, 202, and/or 203 to generate an electrical signal. The respective Hall ICs 101, 102, and 103 are spaced apart from each other. Each Hall IC may be outside the magnetic field detection area of an adjacent Hall IC.

Accordingly, each magnet 201, 202, and 203 is in a predetermined area of a respective storage bin 50, so that only the Hall IC on the box/bin 50 in front of the Hall IC 101, 102, or 103 is capable of detecting the magnetic field. For example, as illustrated in FIG. 3B, the refrigerator chamber includes a plurality of accommodation boxes or storage bins, and each of the plurality of storage bins 50 includes a magnet 201, 202, or 203. When a predetermined storage bin 50 is inserted into the configurable space 30, the magnet 201, 202, or 203 is at a position corresponding to a Hall IC 101, 102, or 103. For example, when a storage bin A is in the configurable space 30, a magnet 201 is proximate to the Hall IC 101. When a storage bin B is in the configurable space 30, a magnet 202 is proximate to the Hall IC 102. When a storage bin C is in the configurable space 30, a magnet 203 is proximate to the Hall IC 103. In one embodiment, each of the magnets 201, 202 and 203 generates a magnetic field of different strength or value, and the controller is configured to distinguish a function and/or environmental condition for each storage bin based on the strength of the magnet 201, 202 or 203 thereon.

Referring to FIG. 4, a storage bin 50 has attachment locations 401, 402, and 403, from which the magnet may be detachable.

The attachment locations 401, 402, and 403 correspond to the locations of the plurality of Hall ICs when the storage bin 50 is inserted into the configurable space 30. For example, the attachment location 401 corresponds to the location of Hall IC 101, the attachment location 402 corresponds to the location of Hall IC 102, and the attachment location 403 corresponds to the location of Hall IC 103. An intensity of the magnet may be selected and/or detected when the Hall IC 101 detects the magnetic field of the magnet 200 on the storage bin 50A attached to the attachment location 401, when the storage bin 50A is inserted into the configurable space 30.

Figure 5:
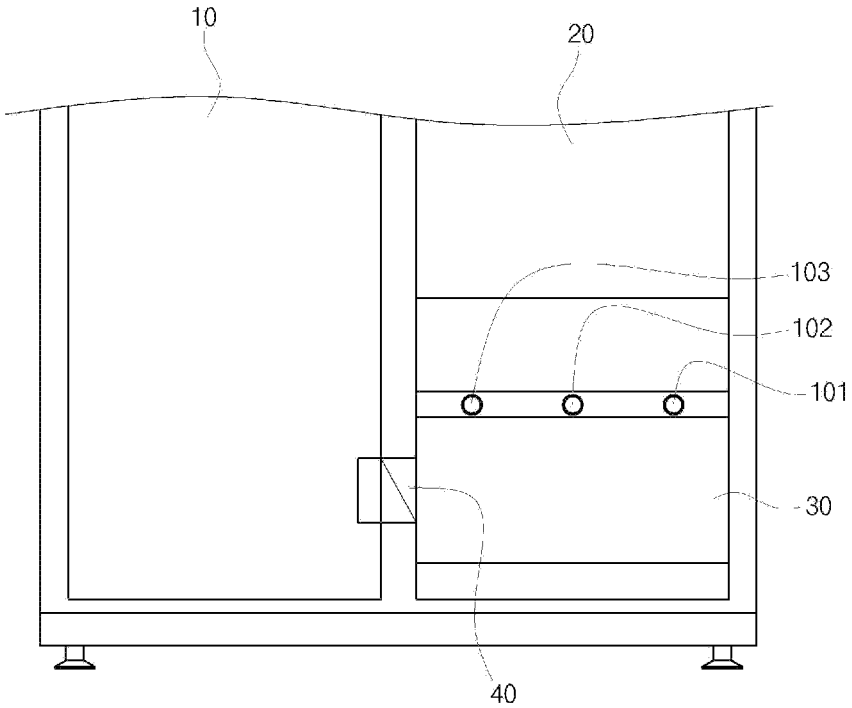
Figure 5:
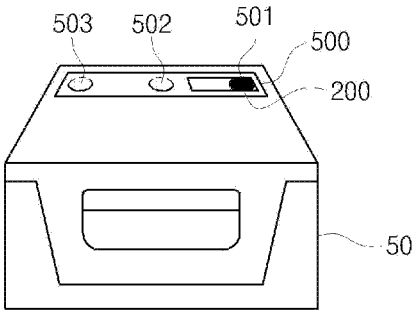

Referring to FIG. 5, a storage bin 50 has an attachment region 500, in which a magnet 200 is positioned. The attachment region 500 may have a shape in which the magnet may be positioned at any of attachment positions 501, 502 and 503 corresponding to a plurality of Hall ICs, when the storage bin 50 is inserted to the configurable space 30. For example, recesses may be formed at the attachment positions 501, 502, and 503, so that the magnet may remain in the attachment positions 501, 502, and 503 corresponding to the Hall ICs 101, 102, 103, respectively.

An intensity of the magnet may be selected and/or detected when the Hall IC 101 detects a magnetic field of the magnet 200 when the magnet 200 is in the attachment position 501 and the storage bin 50 is in the configurable space 30.

Figure 6:
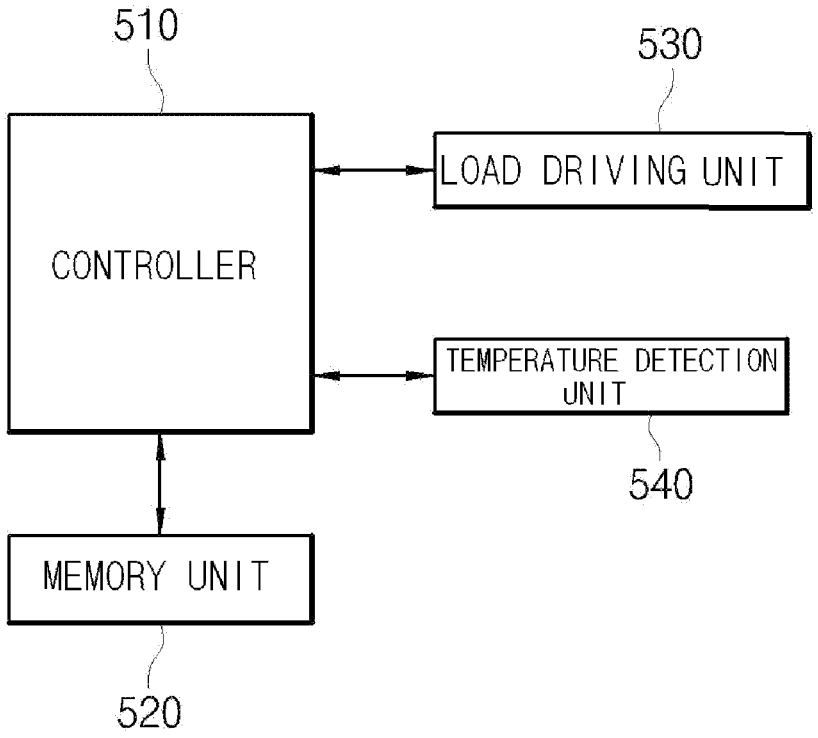
FIG. 6 is a diagram of an exemplary configuration of a function control device for setting an environment of the configurable space of the refrigerator according to embodiments of the present disclosure.

FIG. 6 is a diagram of an exemplary configuration of a function control device configured to set and/or control an environment of the configurable space of the refrigerator chamber according to embodiment of the present disclosure.

The function control device includes a controller 510, a memory unit 520, a load driving unit 530, and a temperature detection unit 540.

The controller 510 receives an electrical signal from the Hall IC and outputs a driving signal based on the received electrical signal to set an environment (e.g., one or more environmental conditions, such as temperature, humidity, etc.) according to information preset or stored in the memory unit 520. The controller 510 controls the load driving unit 530 by referencing temperature information from the configurable space. The temperature detection unit 540 provides the temperature information from the configurable space to the controller 510 to maintain the environment of the configurable space according to the information in the memory 520.

The memory unit 520 stores the preset information. More particularly, predetermined or preset information that matches or corresponds to a desired or a target electrical signal from the Hall IC and is stored in the memory unit 520. When there is a plurality of Hall ICs, different preset or stored information is stored in the memory unit 520 matching or corresponding to the desired or target electrical signal from each Hall IC, respectively. For example, different temperatures, such as 0° C. in a first storage bin, −1° C. in a second storage bin, and −3° C. in a third storage bin, are matched to corresponding electrical signals from the Hall ICs and stored in the memory unit 520.

The load driving unit 530 is configured to drive respective loads to adjust the amount of cold air inflow by a driving signal from the controller 510. Each load may include a duct, a damper, and a blower unit. The duct is on a rear wall surface of the refrigerator chamber in a vertical direction to serve as a transfer path of the cold air from a refrigeration apparatus. The duct may have a plurality of through-outlets (e.g., through holes), so that the cold air may be supplied to the refrigerator chamber. The outlets may be at a lowermost end of the configurable space.

The damper is on the outlet or an inlet of the duct to adjust a discharge rate of the cold air supplied to the configurable space. The damper may comprise an electronic damper. An inside of the configurable space may be maintained at a predetermined temperature by opening and closing the damper.

The blower unit circulates the cold air from the outlet (e.g., which may communicate with a switch room). The blower unit may be included in an outlet of the switch room or an internal side of the refrigerator chamber adjacent to the outlet.

The temperature detection unit 540 detects a temperature within the configurable space and transmits information about the detected temperature to the controller 510.

Figure 7:
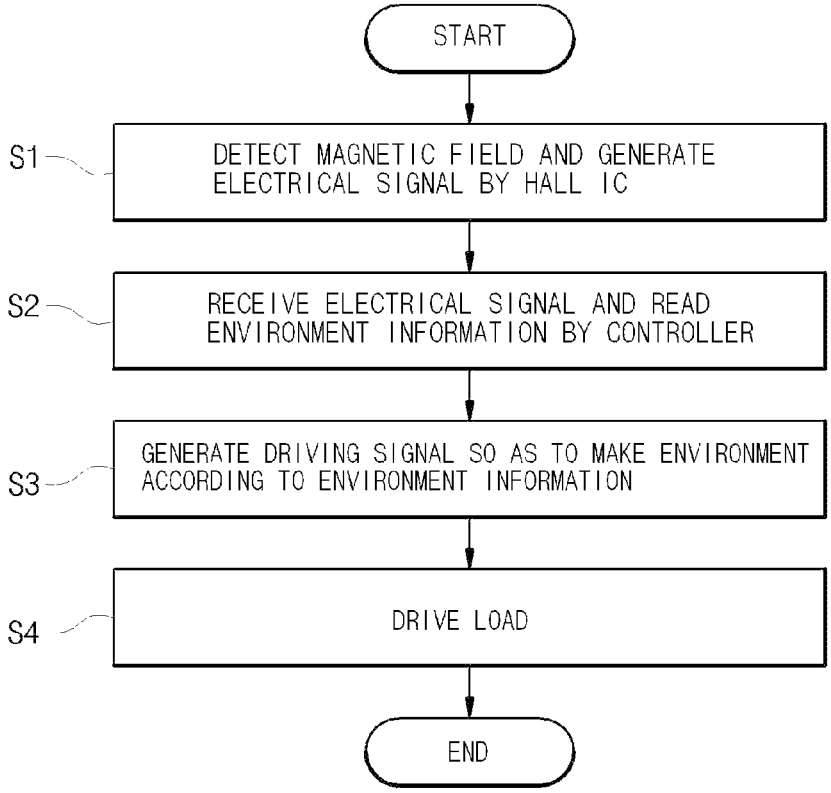
FIG. 7 is a flowchart for describing an exemplary configuration method of the refrigerator according to embodiments of the present disclosure.

FIG. 7 is a flowchart describing an exemplary method of configuring the refrigerator chamber according to embodiments.

When the storage bin is in the configurable space, the Hall IC is on one surface of the configurable space of the refrigerator, and is configured to detect a magnetic field of a magnet on or in the storage bin. The Hall IC generates an electrical signal (illustrated as step S1).

The controller receives the electrical signal from the Hall IC and reads preset or stored environmental information from the memory (illustrated as step S2). The preset or stored environmental information includes one or more values of the electrical signal corresponding to a desired or target value or range of the temperature and/or humidity in the configurable space.

The controller outputs a driving signal for driving a load to adjust or provide the temperature and/or the humidity according to the preset environmental information (illustrated as step S3). The controller receives information about the current temperature of the configurable space from the temperature detection unit. When the current temperature is higher than the preset or predetermined temperature, the controller drives the load to decrease the temperature in the configurable space. However, when the current temperature from the temperature detection unit is lower than the preset or predetermined temperature, the controller stops the driving the load.

The load driving unit drives the load according to the driving signal and adjusts the amount of cold air inflow into the configurable space through the driving signal (illustrated as step S4).

The exemplary embodiments disclosed in the present specification have been described with reference to the accompanying drawings. As described above, the exemplary embodiments illustrated in the respective drawings shall not be limiting, and the exemplary embodiments may be combined by those understanding the contents of the present specification, and when the exemplary embodiments are combined, some constituent elements may be omitted.

Therefore, it should be understood that the exemplary embodiments described above are not limiting, but only an example in all respects. The scope of the present disclosure is expressed by claims below, and not the detailed description. Changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A refrigerator, comprising:

a plurality of Hall effect integrated circuits configured to detect a magnetic field and generate an electrical signal;

a configurable space configured to store different environmental information for each of the plurality of Hall effect integrated circuits;

a function control device configured to control an environment of the configurable space according to the environmental information for each of the Hall effect integrated circuits to generate the electrical signal; and a storage bin configured to be inserted in the configurable space, having a magnet thereon or therein corresponding to a location of at least one of the Hall effect integrated circuits, wherein each of the plurality of Hall effect integrated circuits is outside a magnetic field detection area of an adjacent Hall effect integrated circuit, wherein the function control device comprises:

a memory unit configured to store different preset environmental information matching or corresponding to a desired or a target electrical signal from each Hall effect integrated circuit;

a controller configured to output a driving signal to provide or adjust an environment of the configurable space according to the environmental information and the electrical signal of the Hall effect integrated circuit.

2. The refrigerator of claim 1, comprising a plurality of storage bins.

3. The refrigerator of claim 2, wherein the magnets in or on the respective storage bins correspond to each of the plurality of Hall effect integrated circuits.

4. The refrigerator of claim 1, wherein the storage bin comprises a plurality of attachment positions that correspond to locations of the plurality of Hall effect integrated circuits.

5. The refrigerator of claim 1, wherein the storage bin has an attachment position on or in which the magnet is attached, so that the magnet is movable to positions that correspond to each of the plurality of Hall effect integrated circuit.

6. The refrigerator of claim 1, wherein the function control device comprises:

a load driving unit configured to drive a load configured to adjust the amount of cold air inflow to the configurable space according to the driving signal.

7. A method of configuring a refrigerator, comprising:

detecting, by any of a plurality Hall effect integrated circuit, a magnetic field of a magnet on or in a storage bin and generating an electrical signal;

receiving the electrical signal and reading environmental information in a memory by a controller;

outputting from the controller a driving signal configured to drive a load to provide or adjust at least one of temperature and humidity according to the environmental information;

adjusting the amount of cold air inflow by a load driving unit according to the driving signal wherein the memory stores different preset environmental information matching or corresponding to a desired or a target electrical signal from each Hall effect integrated circuit.

8. The method of claim 7, further comprising driving the load to decrease a temperature within the configurable space when a temperature of the configuration space is higher than a predetermined temperature.

9. The method of claim 7, further comprising stopping driving the load when the temperature of the configuration space is lower than the predetermined temperature.

* * * * *